US008134094B2

(12) United States Patent
Tsao et al.

(10) Patent No.: US 8,134,094 B2
(45) Date of Patent: Mar. 13, 2012

(54) LAYERED THIN-TYPE KEYCAP STRUCTURE

(75) Inventors: Kai-Jie Tsao, Taoyuan (TW); Kuo-Long Chen, Taoyuan (TW)

(73) Assignee: Ichia Technologies, Inc., Hwa-Ya Tech. Park, Gueishan, Taoyuan (TW)

( * ) Notice: Subject to any disclaimer, the term of this patent is extended or adjusted under 35 U.S.C. 154(b) by 253 days.

(21) Appl. No.: 12/407,781

(22) Filed: Mar. 19, 2009

(65) Prior Publication Data

US 2010/0163389 A1 Jul. 1, 2010

(30) Foreign Application Priority Data

Dec. 29, 2008 (TW) ..... 97151187 A

(51) Int. Cl.
*H01H 13/70* (2006.01)

(52) U.S. Cl. ..... 200/345

(58) Field of Classification Search ..... 200/345, 200/512, 514, 516
See application file for complete search history.

(56) References Cited

U.S. PATENT DOCUMENTS

| | | | | |
|---|---|---|---|---|
| 5,807,002 | A * | 9/1998 | Tsai | 400/494 |
| 6,596,954 | B2 * | 7/2003 | Miyashita | 200/406 |
| 6,658,773 | B2 * | 12/2003 | Rohne et al. | 40/542 |
| 6,762,381 | B2 * | 7/2004 | Kunthady et al. | 200/512 |
| 6,835,906 | B2 * | 12/2004 | Okamoto et al. | 200/341 |

FOREIGN PATENT DOCUMENTS

| | | | |
|---|---|---|---|
| CN | 1269589 | A | 10/2000 |
| CN | 1332462 | A | 1/2002 |
| CN | 101236850 | A | 8/2008 |
| CN | 101293400 | A | 10/2008 |
| JP | 2008-192522 | | 8/2008 |
| JP | 2008-246874 | | 10/2008 |
| JP | 2008-251323 | | 10/2008 |
| TW | 490697 | | 6/2002 |
| TW | M289251 | | 4/2006 |
| TW | 200837791 | | 9/2008 |

* cited by examiner

*Primary Examiner* — Vanessa Girardi
(74) *Attorney, Agent, or Firm* — Winston Hsu; Scott Margo

(57) ABSTRACT

A thin-type keycap structure comprising a key cap layer and a plastic film on the upper surface of the key cap layer. The thin-type keycap structure and the metal dome on a PCB are assembled to form a keypad structure. The thin-type keycap structure is made through compression molding of the plastic film and a resin together. The surface of the plastic film may be embossed before the compression molding.

27 Claims, 8 Drawing Sheets

LAYERED THIN-TYPE KEYCAP STRUCTURE

BACKGROUND OF THE INVENTION

1. Field of the Invention

The present invention relates to a keypad structure, and particularly to a thin-type keycap structure and a keypad structure including such keycap structure and a method of making such keycap structure.

2. Description of the Prior Art

Due to the development of electronic technology, the demand for keypads is dramatically increasing. The keypads used in calculators, mobile phones and the like further have to be relatively thin and small for the device with reduced size and weight as desired.

A thin-type keycap is conventionally formed by molding. As shown in FIG. 1, a film 2 is compressed and drawn in a mold 4 in order to have bulged portions 6 each in a keycap shape. There is a hollowed recession 8 beneath each bulged portion 6. Thereafter, a resin 9, such as UV curable resin, is injected into each recession 8 by an injection machine and cured. The injection temperature is usually higher than 200° C.

It is known that the molding of the film 2 in the mold 4 can be performed by hot press through a male mold and a female mold. In such process, a printing layer of characters and graphs is printed on the bottom surface of the film 2 in advance. When the film 2 is hot pressed to gain the keycap contour using the male mold and the female mold, the ink of the printing layer, especially at corners of the keycap contour, may be thinned out or broken, due to the stretching and deformation of the film 2. It will decrease the product yield. Alternatively, it is known that the film 2 is molded through pressing the film 2 tightly on a bottom mold in accordance with the profile of the bottom mold by vacuum, so as to impart the mold profile to the film 2. However, the vacuum process is time-consuming and costly.

Furthermore, conventionally, if it is desired that the outer surface of the film 2 has a pattern, the pattern is often formed by placing an additional pattern layer thereon. In this way, the thickness is undesirable increased and the fabrication is more complicated.

Therefore, there is still a need for a novel keycap structure and a method of making the same for making keypads economically and conveniently.

SUMMARY OF THE INVENTION

One objective of the present invention is to provide a thin-type keycap structure, a keypad structure comprising such keycap structure, and a method of making such keycap structure, to improve the fabrication process and further impart an attractive texture to keycap surface impressions.

The thin-type keycap structure according to the present invention comprises a key cap layer and a plastic film. The key cap layer comprises a resin and has a top surface, a side surface, and a bottom surface. The plastic film covers only the top surface of the key cap layer.

The thin-type keypad structure according to the present invention comprises a circuit board comprising a plurality of electrical connection sites; a plurality of metal domes disposed above the electrical connection sites respectively, wherein, when the metal domes are pressed, the metal domes are electrically connected to the underlying electrical connection sites; a plurality of plungers disposed above the metal domes respectively; and a plurality of keycap structures as described above disposed above the plungers respectively.

The method of making a thin-type keycap structure according to the present invention comprises steps as follows. First, a plastic film having a first surface and a second surface, a mold including a top mold and a bottom mold, and a resin are provided. The bottom mold comprises a surface with a plurality of first recessions. Next, the plastic film with the resin is together compression-molded with the mold to form a compression-molded laminate including the resin layer and the plastic film, such that the first surface of the plastic film faces the bottom mold, the resin faces the top mold. The resulted compression-molded laminate has a plastic film surface and a resin surface, the plastic film surface includes a plurality of bulged portions corresponding to the first recessions of the surface of the bottom mold, and the bulged portions each comprise a portion of the plastic film and a portion of the resin.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
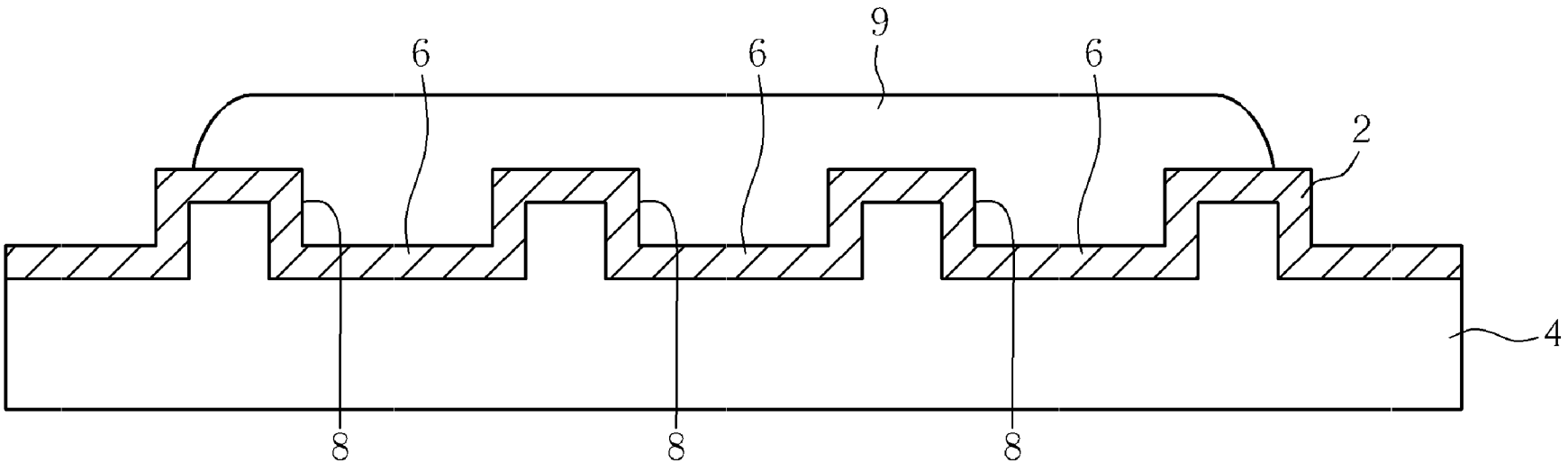
FIG. 1 PRIOR ART
FIG. 1 is a cross-sectional view schematically illustrating a conventional method of making a keycap.
Figure 2:
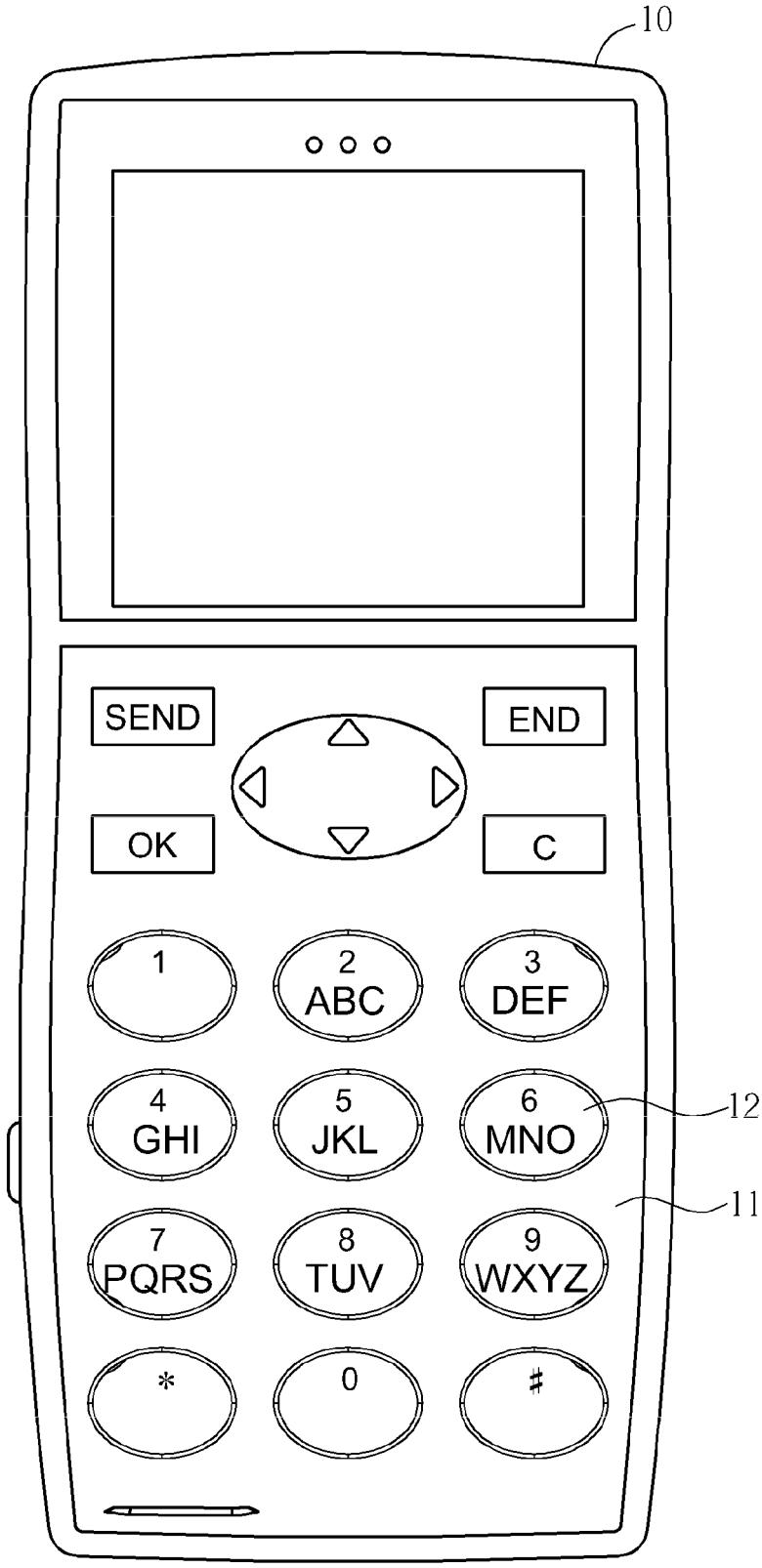
FIG. 2 is a plan view schematically illustrating an application of the keycap structure or keypad structure according to the present invention in an electronic device.
Figure 3:
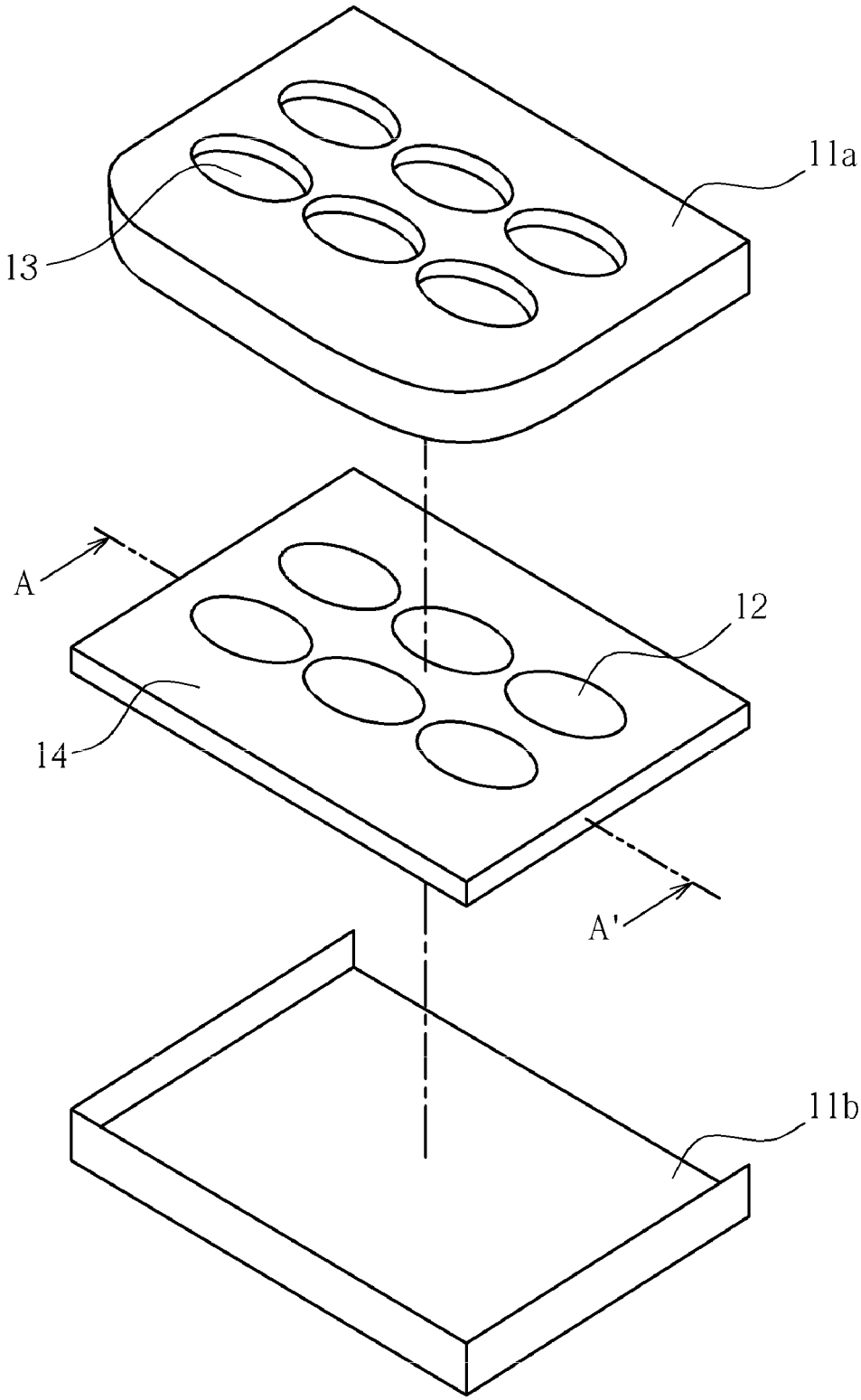
FIG. 3 is a partial explosive view schematically illustrating a portion of the electronic device shown in FIG. 2.
Figure 4:
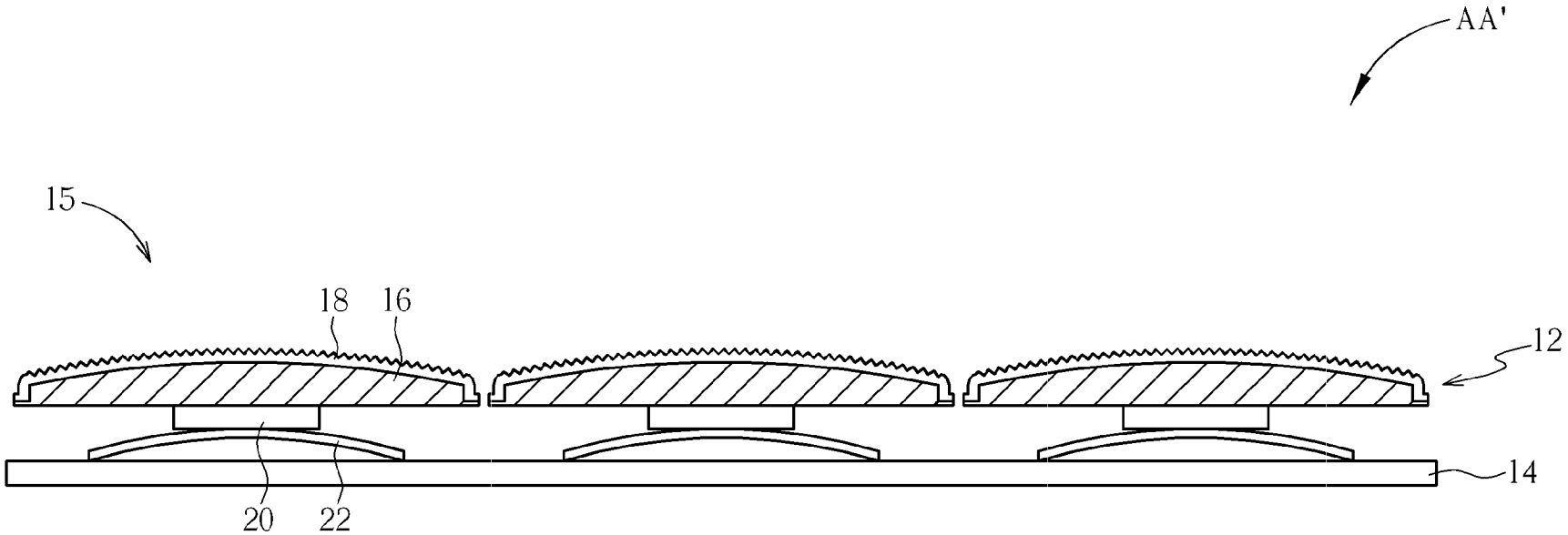
FIG. 4 is a cross-sectional view schematically illustrating the keypad structure along the line AA' shown in FIG. 3.

The keycap structure or keypad structure according to the present invention is applicable in electronic devices. Referring to FIG. 2, an electronic device 10 includes a frame 11 and a plurality of keycap structures 12 exposed from openings on the frame 11. FIG. 3 is a partial explosive view schematically illustrating a portion of the electronic device 10. Keycap structures 12 are disposed on the circuit board 14 to form a keypad structure housed in the upper frame 11 a and the lower frame 11*b*. The keycap structures 12 are exposed from the openings 13 of the upper frame 11*a* for users to press. FIG. 4 is a cross-sectional view schematically illustrating the keypad structure along the line AA' shown in FIG. 3.

Figure 5:
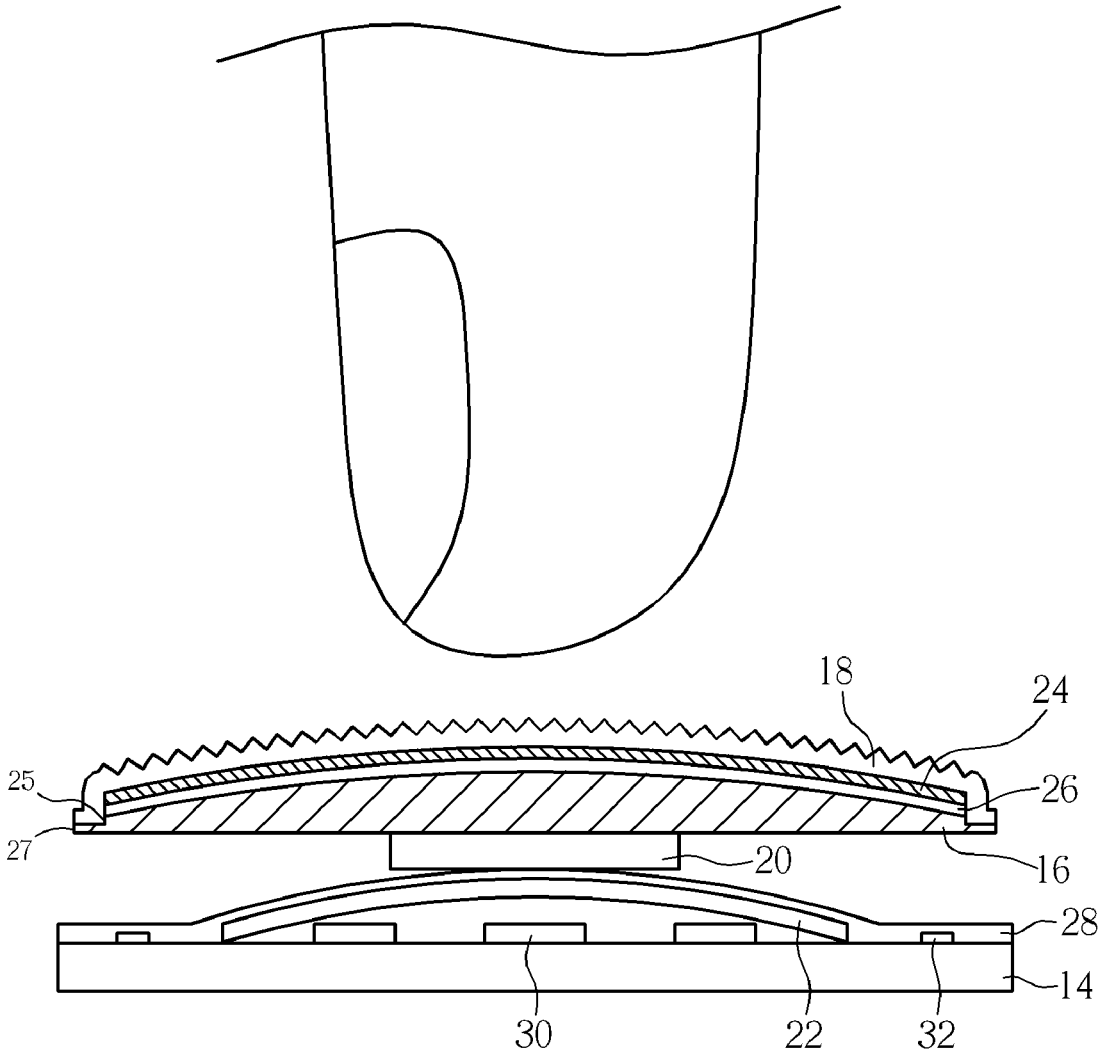
FIG. 5 is a cross-sectional view schematically illustrating an embodiment of the keypad structure according to the present invention.

As shown in FIG. 4 and FIG. 5, the thin-type keypad structure 15 according to the present invention includes a circuit board 14, a plurality of metal domes 22, a plurality of plungers 20, and a plurality of keycap structures 12. The metal domes 22 are each disposed on the circuit board 14. The plungers 20 are disposed on the metal domes 22, respectively. The keycap structures 12 are disposed above the plungers 20, respectively. The keycap structure 12 includes a key cap layer 16 and a plastic film 18. The key cap layer 16 includes a resin and has a top surface, a side surface 25, a side end surface 27 and a bottom surface. The side surface 25 is not directly adjacent to the side end surface 27. The plastic film 18 only covers the top surface and directly contacts the side surface 25 of the key cap layer 16 and does not cover the side end surface 27 and the bottom surface of the key cap layer 16, due to the fabrication method according to the present invention. The printing layer 24 does not contact the side surface 25 and the side end surface 27 of the key cap layer 16. The plastic film may be a film having properties of plasticity, such as polycarbonate (PC) film and the like. The resin may be for example polyurethane (PU), epoxy, and the like.

Further in detail, as shown in the cross-sectional view of FIG. 5, the keycap structure 12 may optionally include other components in addition to the main components as described above. The plastic film 18 has an outer surface, which is a surface for users to press. The outer surface may further have embossment 19 which may be for example a pattern or a light interference layer. The inner surface of the plastic film 18 is the surface to be laminated with the resin. A printing layer 24 may be printed on the inner surface in advance. Thus, the printing layer 24 is disposed between the upper surface of the key cap layer 16 and the plastic film 18. The printing layer 24 mainly imparts characters or graphs to the keypad and may be for example a colored opaque material, but not limited thereto. If desired, a protective film 26 may be further disposed on the inner surface of the plastic film 18 to cover the printing layer 24, for protecting the ink of the printing layer 24 from being blurred by the melt resin in the subsequent process, or for giving color to the entire keycap. The protective film 26 may be a colored or colorless transparent or opaque layer.

With respect to the metal domes 22, they may be fixed on the circuit board 14 by, for example, utilizing a metal dome adhesive sheet 28 to cover the metal domes 22 thereby to attach the metal domes 22 on the circuit board 14. The circuit board 14 includes a plurality of electrical connection sites, such as printed circuit 30, disposed thereon. The metal domes 22 disposed above the electrical connection sites respectively. When the metal domes are pressed, they are electrically connected to the underlying electrical connection sites. One or more light-emitting diode (LED) devices 32 may be disposed on the circuit board 14 for emitting light and serve as backlight of the keypad structure.

The plunger 20 is disposed above the metal dome 12. The plunger 20 may be a separate part attached to either the metal dome 22 or the keycap structure 12. Alternatively, the plunger 20 may be formed integrally with the key cap layer 16 of the keycap structure 12.

Figure 6:
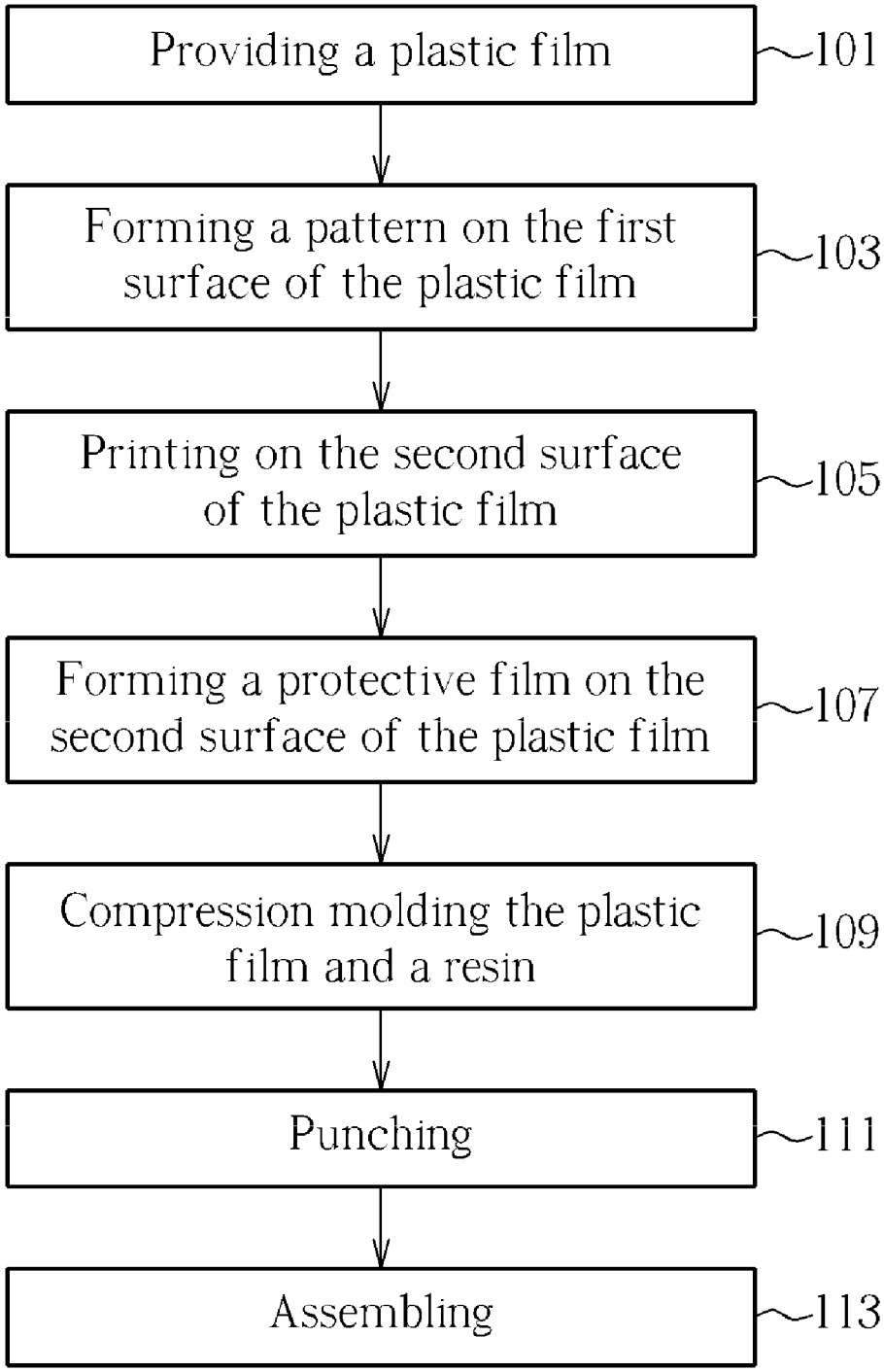
FIG. 6 is a flow chart illustrating an embodiment of the method of making a keycap structure according to the present invention.
Figure 7:
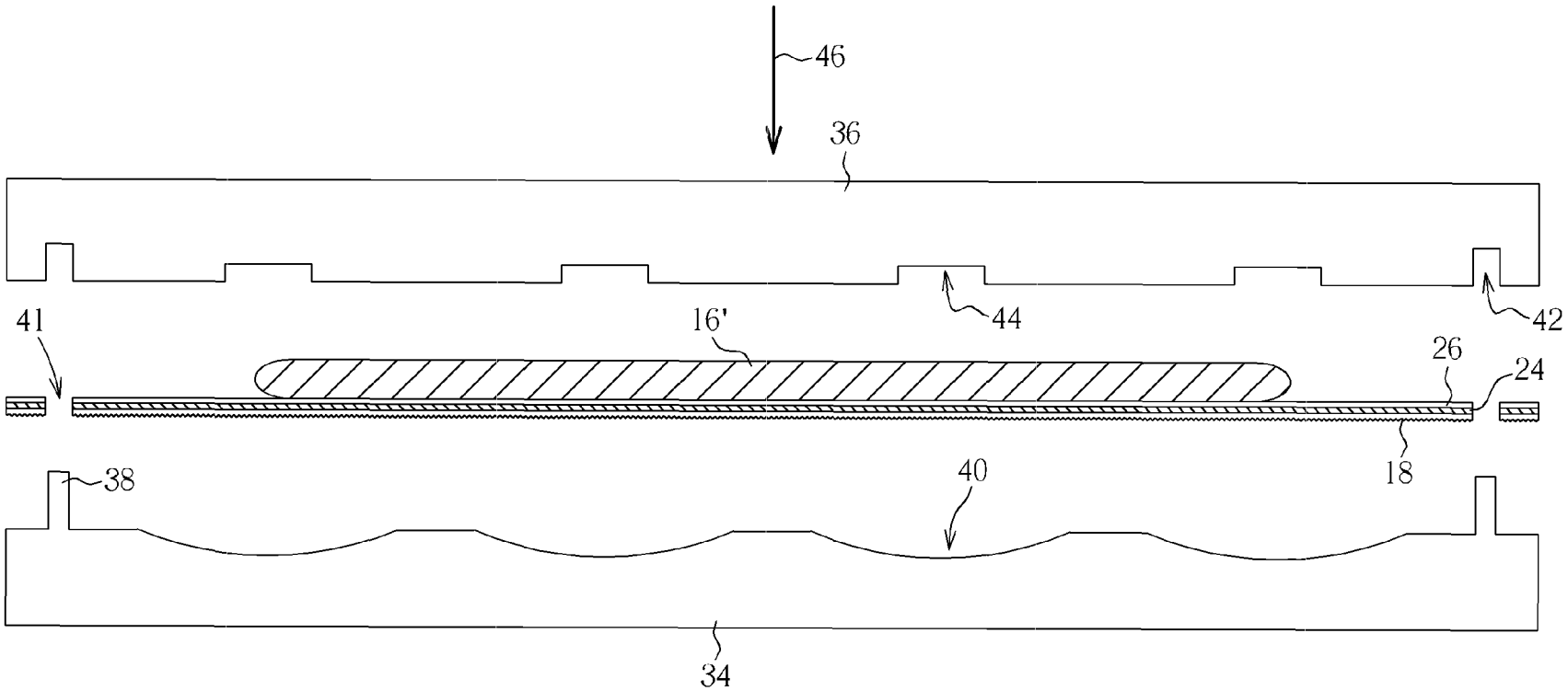
FIGS. 7 and 8 are cross-sectional views schematically illustrating an embodiment of the method of making the keycap structure according to the present invention.

Hereinafter, the method of making a keycap structure according to the present invention is described further in detail. Please refer to the flow chart of FIG. 6 and the schematic view of FIG. 7. First, a step 101 is performed to provide an aforesaid plastic film 18. A step 103 may be optionally performed to emboss the first surface of the plastic film 18 through, for example, a hot rolling process to form a pattern or a light interference layer. A step 105 may be optionally further performed to print a printing layer 24 on the second surface of the plastic film 18 using, for example, a screen printing process, but not limited thereto. A step 107 may be optionally further performed to form a protective film 26 on the second surface of the plastic film 18. Thereafter, a step 109 is performed to compression-mold the plastic film 18 and the resin 16' together. For example, a mold including a bottom mold 34 and a top mold 36 is provided. The surface of the bottom mold 34 has a plurality of recessions 40 each corresponding to a shape of keycap. The shape of keycap may be a round bulge shape, a square bulge shape, or others with a slight bulge shape, but not limited thereto. The top mold 36 may be flat, or the top mold 36 may further have recessions 44 each corresponding to a shape of plunger, such that the plungers 48 and the key cap layer 16 may be formed integrally. The top and bottom molds may further include locating holes and locating plugs. In this embodiment, locating plugs 38 are formed on the bottom mold 34, locating holes 42 corresponding to the locating plugs 38 are formed on the top mold 36, and locating holes 41 corresponding to the locating plugs 38 are formed on the plastic film 18.

Figure 8:
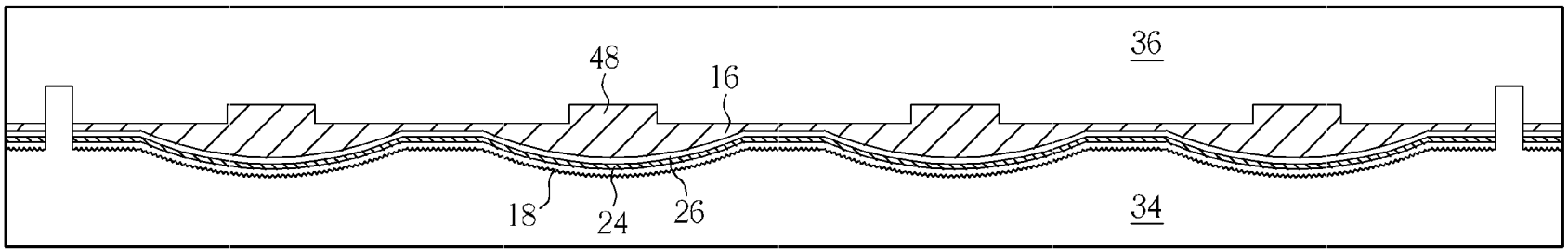

The plastic film 18 not being plasticized yet is placed on the bottom mold to allow the first surface of the plastic film 18 to face the surface of the bottom mold 34. The first surface of the plastic film 18 may have been further embossed, or films or layers, such as a protective film or a printing layer, may have been formed on the second surface of the plastic film 18. As shown in FIG. 8, a suitable amount of resin 16' is placed on the second surface of the plastic film 18, and then the top mold 36 and the bottom mold 34 are closed up. A proper pressure 46 is applied to the mold, to compression-mold the plastic film 18 and the resin 16' together. The resin 16' is a resin, such as PU resin, epoxy resin, and the like, containing appropriate and suitable amount of additives. Thus, when the compression molding is performed, the resin may be brought to a melt or viscous state at a proper temperature, such that the resin can be molded with the plastic film together. Suitable temperature is one that will not damage the plastic film 18 and other films or layers in the process. For example, with respect to PU resin, the temperature in a range of from 100 to 120° C. may be used, but not limited thereto.

The resin 16' is cured to form a compression-molded laminate with the plastic film 18 together after the compression molding. The resulted compression molded laminate has two outer surfaces located up and down respectively. One is a plastic film surface, and the other is a resin surface. The plastic film surface has a plurality of bulged portions corresponding to the recessions on the surface of the bottom mold. The bulged portions each include both of a portion of the plastic film and a portion of the resin.

Thereafter, a step 111 of punching is performed to cut out each keycap structure from the compression-molded laminate corresponding to the shape of the bulged portions.

Finally, a step 113 of assembly is performed to attach the keycap structures on the metal domes on the circuit board correspondingly, to obtain a keypad structure.

Compared with conventional techniques, in the fabrication process of the keycap structure according to the present invention, the plastic film and the resin (such as PU resin) are together compression-molded to form a structure like PU-in-Plastic. The process temperature is relatively low and does not damage the parts or components. Furthermore, the outer surface of the plastic film can be directly embossed by a roller in advance, followed by compression-molding the plastic film having the embossed surface and the resin together through a mold. The process is simple and the embossed surface won't be damaged.

Those skilled in the art will readily observe that numerous modifications and alterations of the device and method may be made while retaining the teachings of the invention.

What is claimed is:

1. A thin-type keycap structure, comprising:

a resin key cap layer having an upper surface, a side end surface, and a flat bottom surface which spans the upper surface, wherein the upper surface has a bulge shape;

a plastic film covering the upper surface of the key cap layer which does not cover the side end surface or the bottom surface of the key cap layer; and a printing layer between the upper surface of the key cap layer and the plastic film, wherein the key cap layer, the printing layer and the plastic film are together in a form of a compression-molded laminate.

2. The thin-type keycap structure of claim 1, wherein the plastic film comprises an outer surface and the outer surface is embossed.

3. The thin-type keycap structure of claim 1, wherein the resin comprises polyurethane.

4. The thin-type keycap structure of claim 1, wherein the resin comprises epoxy.

5. The thin-type keycap structure of claim 1, wherein, the bottom surface of the key cap layer is flat.

6. The thin-type keycap structure of claim 1, wherein, the bottom surface of the key cap layer has a flat shape and a plunger shape.

7. The thin-type keycap structure of claim 1, wherein, the key cap layer is a single layer without a joint.

8. The thin-type keycap structure of claim 1, wherein, the side end surface of the key cap layer is aligned with a side end surface of the plastic film.

9. The thin-type keycap structure of claim 1, further comprising a protective layer between the upper surface of the key cap layer and the printing layer for protecting the printing layer.

10. The thin-type keycap structure of claim 9, wherein the protective layer is a colored transparent layer.

11. The thin-type keycap structure of claim 1, wherein, the key cap layer further has a side surface not directly adjacent to the side end surface, the plastic film directly contacts the side surface and the printing layer does not contact the side surface and the side end surface.

12. The thin-type keycap structure of claim 11, wherein, the key cap layer is a single layer without a joint, and the bottom surface of the key cap layer is flat.

13. The thin-type keycap structure of claim 11, wherein, the key cap layer is a single layer without a joint, and the bottom surface of the key cap layer has a flat shape and a plunger shape.

14. A thin-type keypad structure, comprising:

a circuit board comprising a plurality of electrical connection sites;

a plurality of metal domes disposed above the electrical connection sites respectively, wherein, when the metal domes are pressed, the metal domes are electrically connected to the underlying electrical connection sites;

a plurality of plungers disposed above the metal domes respectively; and a plurality of keycap structures disposed above the plungers respectively and each comprising:

a resin key cap layer having an upper surface, a side end surface, and a flat bottom surface which spans the upper surface, wherein the upper surface has a bulge shape;

a plastic film covering the upper surface of the key cap layer which does not cover the side end surface or the bottom surface of the key cap layer; and a printing layer between the upper surface of the key cap layer and the plastic film, wherein the key cap layer, the printing layer and the plastic film are together in a form of a compression-molded laminate.

15. The thin-type keypad structure of claim 14, wherein the plastic film comprises an outer surface and the outer surface is embossed.

16. The thin-type keypad structure of claim 14, further comprising a protective layer between the upper surface of the key cap layer and the printing layer for protecting the printing layer.

17. The thin-type keypad structure of claim 14, further comprising a metal dome adhesive sheet covering and adhering to the metal domes and the circuit board for fixing the metal domes on the circuit board.

18. The thin-type keypad structure of claim 14, wherein the plungers are integrally formed with the key cap layers respectively.

19. The thin-type keypad structure of claim 14, wherein the resin comprises polyurethane.

20. The thin-type keypad structure of claim 14, wherein the resin comprises epoxy.

21. The thin-type keycap structure of claim 14, wherein, the bottom surface of the key cap layer is flat.

22. The thin-type keycap structure of claim 14, wherein, the bottom surface of the key cap layer has a flat shape and a plunger shape.

23. The thin-type keycap structure of claim 14, wherein, the key cap layer is a single layer without a joint.

24. The thin-type keycap structure of claim 14, wherein, the side end surface of the key cap layer is aligned with a side end surface of the plastic film.

25. The thin-type keycap structure of claim 14, wherein, the key cap layer further has a side surface not directly adjacent to the side end surface, the plastic film directly contacts the side surface and the printing layer does not contact the side surface and the side end surface.

26. The thin-type keycap structure of claim 15, wherein, the key cap layer is a single layer without a joint, and the bottom surface of the key cap layer is flat.

27. The thin-type keycap structure of claim 25, wherein, the key cap layer is a single layer without a joint, and the bottom surface of the key cap layer has a flat shape and a plunger shape.

* * * * *